US009037013B2

(12) United States Patent
Kitamoto

(10) Patent No.: US 9,037,013 B2
(45) Date of Patent: May 19, 2015

(54) IMAGE FORMING APPARATUS AND PRINTING METHOD

(71) Applicant: Kyocera Document Solutions Inc., Osaka (JP)

(72) Inventor: Daijiro Kitamoto, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/974,752

(22) Filed: Aug. 23, 2013

(65) Prior Publication Data

US 2014/0064765 A1 Mar. 6, 2014

(30) Foreign Application Priority Data

Aug. 30, 2012 (JP) ..... 2012-190311

(51) Int. Cl.
*G03G 15/00* (2006.01)
*G03G 15/20* (2006.01)

(52) U.S. Cl.
CPC ..... *G03G 15/5016* (2013.01); *G03G 15/5029* (2013.01); *G03G 15/2046* (2013.01)

(58) Field of Classification Search
CPC ..... G03G 15/5029
USPC ..... 399/45, 69, 81
See application file for complete search history.

(56) References Cited

U.S. PATENT DOCUMENTS

| | | | | |
|---|---|---|---|---|
| 5,809,367 | A * | 9/1998 | Yoo et al. | 399/45 |
| 2007/0059003 | A1 | 3/2007 | Shinshi et al. | |
| 2007/0264039 | A1* | 11/2007 | Saito et al. | 399/81 |
| 2010/0289207 | A1* | 11/2010 | Mano | 271/3.14 |
| 2011/0229237 | A1* | 9/2011 | Hayashi | 400/76 |

FOREIGN PATENT DOCUMENTS

| | | |
|---|---|---|
| JP | 06-119096 | 4/1994 |
| JP | 07-061086 | 3/1995 |

OTHER PUBLICATIONS

Japanese Office Action 2012-190311 dated Aug. 19, 2014, 6 pages.

* cited by examiner

*Primary Examiner* — Rodney Bonnette
(74) *Attorney, Agent, or Firm* — K&L Gates LLP

(57) ABSTRACT

An image forming apparatus includes an input unit, a display unit, an image forming unit, a storage unit, a first-page print execution information setting unit, and a print control unit. The first-page print execution information setting unit stores information in the storage unit. The information relates to execution of printing the first page of a job on a sheet on a manual feed tray. If printing on a long nonstandard-size sheet is selected, the print control unit causes the display unit to display an indication prompting a user to identify the sheet size and requests the image forming unit to start printing the sheet on the manual feed tray after a print start instruction. If the information is stored in the storage unit, the print control unit skips the step of displaying the indication and requests the image forming unit to start the printing on the sheet on the manual feed tray.

4 Claims, 4 Drawing Sheets

IMAGE FORMING APPARATUS AND PRINTING METHOD

INCORPORATION BY REFERENCE

This application is based upon, and claims the benefit of priority from, corresponding Japanese Patent Application No. 2012-190311, filed on Aug. 30, 2012, the entire contents of which are incorporated herein by reference.

BACKGROUND

Unless otherwise indicated herein, the description in this section is not prior art to the claims in this application and is not admitted to be prior art by inclusion in this section.

The present disclosure relates to an image forming apparatus for printing on a sheet that is placed on a manual feed tray. In particular, the present disclosure relates to an image forming apparatus for printing on long nonstandard-size sheets.

At times it is necessary to print on a long nonstandard-size sheet using an image forming apparatus to create, for example, point of purchase ("POP") advertising. In this case, a user places a long nonstandard-size sheet on a manual feed tray and specifies the size of the sheet using an operation panel. The user performs printing by pressing a print start button.

The preset temperature for a fixing device that fixes a toner image transferred to the sheet by heating and pressure application is properly set in an automatic manner based on the sheet size and type specified by the user. If the size of the sheet placed on the manual feed tray differs from the specified sheet size, a problem arises in that the preset temperature for the fixing device differs from the temperature suited for the sheet to be actually subjected to printing. This problem leads to an increased load on the apparatus or contamination inside the apparatus.

One approach to address this problem is a method of displaying a screen for requesting a user to identify the size of a sheet when the sheet is placed on a manual feed tray and not allowing printing to be performed unless the user replies to the request. However, when the printing is to be sequentially performed on a plurality of sheets, the user must identify the size of a sheet every time the sheet is placed on the manual feed tray. This operation is burdensome and annoying to the user.

SUMMARY

An image forming apparatus according to an embodiment of the present disclosure includes an input unit, a display unit, an image forming unit, a storage unit, a first-page print execution information setting unit, and a print control unit. The first-page print execution information setting unit is configured to store information in the storage unit. The information relates to execution of printing the first page of a print job on a sheet placed on a manual feed tray. If printing on a long nonstandard-size sheet is selected through the input unit, the print control unit is configured to cause the display unit to display an indication that prompts a user to identify a sheet size of the sheet and requests the image forming unit to start printing the sheet on the manual feed tray in response to an instruction to start printing from the input unit. If the information relating to execution of printing the first page is stored in the storage unit, the print control unit is configured to skip the step of displaying the indication that prompts the user to identify the sheet size on the display unit and to request the image forming unit to start the printing on the sheet placed on the manual feed tray.

A printing method according to another embodiment of the present disclosure is a printing method of printing on a long nonstandard-size sheet. The printing method includes selecting and inputting printing on a long nonstandard-size sheet, storing information relating to printing the first page of a print job on a sheet placed on a manual feed tray, displaying an indication that prompts a user to identify a sheet size of the sheet on a display unit and requesting an image forming unit to start printing for the sheet on the manual feed tray in response to an instruction to start the printing if printing on a long nonstandard-size sheet is selected, and skipping the step of displaying the indication that prompts the user to identify the sheet size on the display unit and requesting the image forming unit to start the printing on the sheet placed on the manual feed tray if the information relating to execution of printing the first page is stored.

Additional features and advantages are described herein, and will be apparent from the following Detailed Description and the figures.

DETAILED DESCRIPTION

Example apparatus and method are described herein. Other example embodiments or features may further be utilized, and other changes may be made, without departing from the spirit or scope of the subject matter presented herein. In the following detailed description, reference is made to the accompanying drawings, which form a part thereof.

An embodiment of the present disclosure will be described below with reference to the drawings.

Figure 1B:
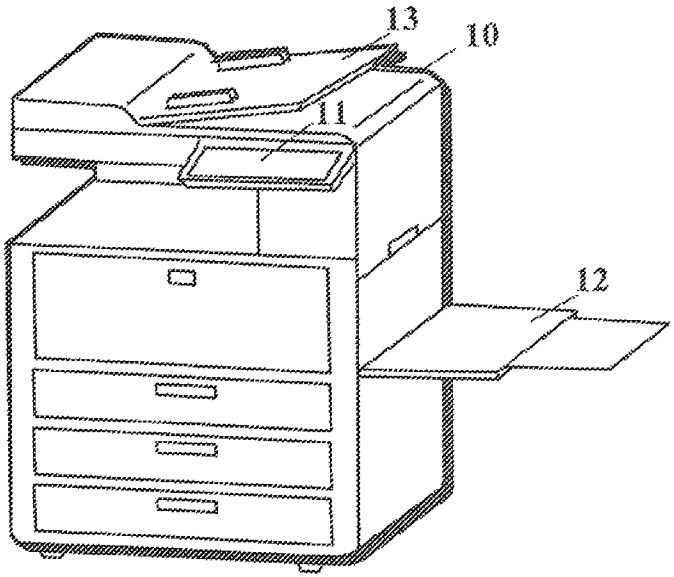
FIGS. 1A and 1B show perspective views that illustrate an image forming apparatus and describe an operation occurring in printing on a long nonstandard-size sheet on a manual feed tray.
Figure 1A:
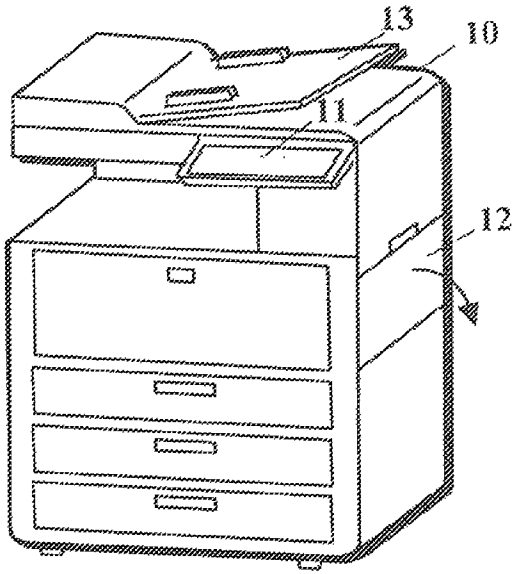

The situation where an image forming apparatus 10 illustrated in FIG. 1A prints on a long nonstandard-size sheet will be described. A user specifies various settings by manipulating an operation panel 11. At this time, the user selects a long nonstandard-size sheet as the sheet size and enters its size.

The back of a manual feed tray 12 constitutes a part of a side of the image forming apparatus 10. FIG. 1A illustrates the closed state of the manual feed tray 12. The user pulls out the upper end of the manual feed tray 12 in this state and makes the manual feed tray 12 pivot about its lower end by 90 degrees. Then the user extends an auxiliary tray at the tip of the manual feed tray 12 and brings the manual feed tray 12 into the position illustrated in FIG. 1B. The user places a long sheet on the manual feed tray 12.

The image forming apparatus 10 detects the placement of the sheet using a sensor. When the user wants to copy, he or she places a long original on an original tray 13 of an automatic document feeder in the upper portion of the image forming apparatus 10. Then the user presses a start button on the operation panel 11 to starts the copying process.

Figure 2:
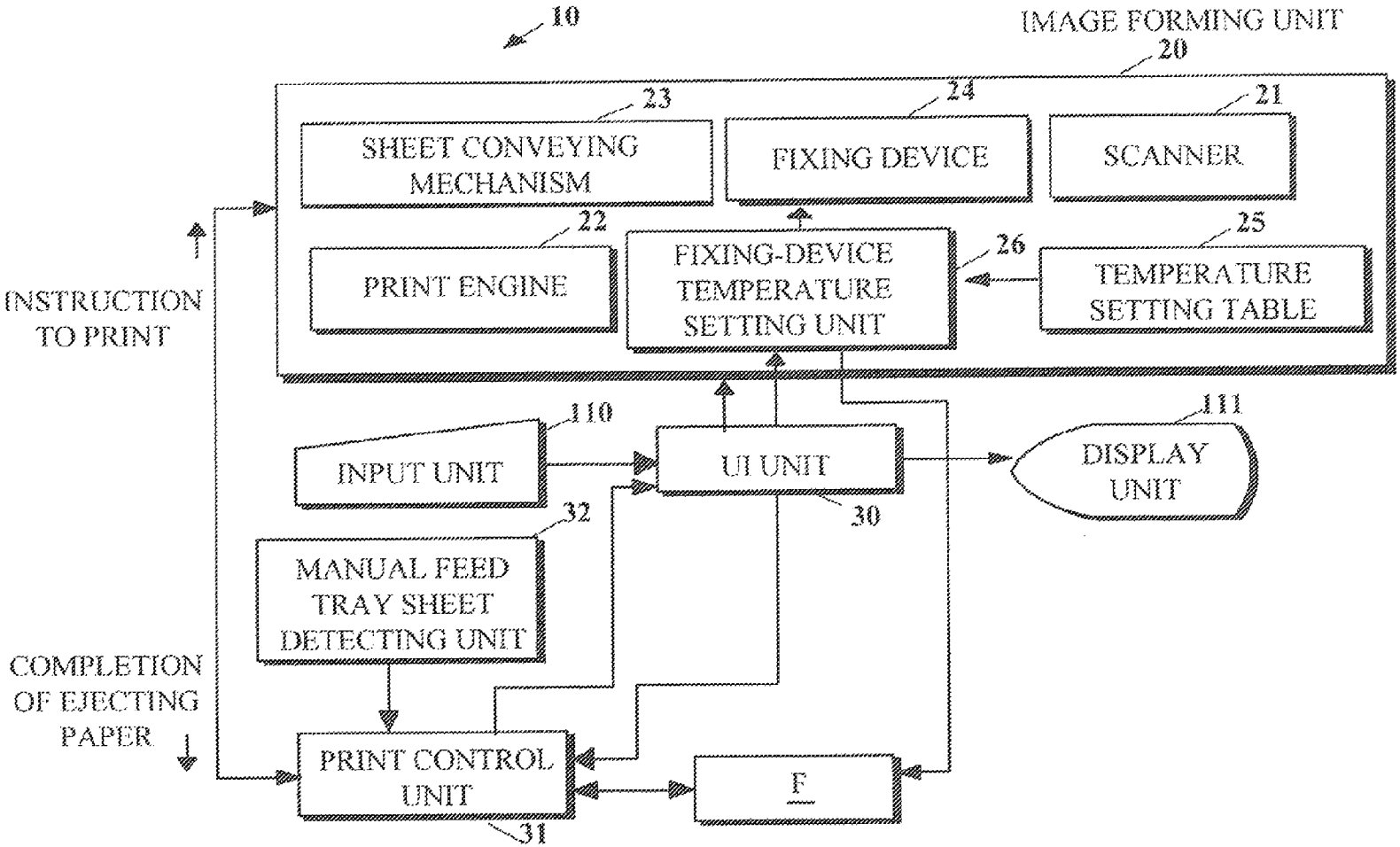
FIG. 2 shows a schematic functional block diagram of the image forming apparatus.

FIG. 2 shows a schematic functional block diagram of the image forming apparatus 10.

The operation panel 11 includes an input unit 110 and a display unit 111. An image forming unit 20 includes a scanner 21, a print engine 22, a sheet conveying mechanism 23, and a fixing device 24.

The scanner 21 converts an image on the original into electronic form to obtain electronic image data. The print engine 22 creates an electrostatic latent image on a photosensitive drum based on the electronic image data. The print engine 22 develops the electrostatic latent image using toner and transfers the toner image on the sheet. The sheet conveying mechanism 23 feeds the sheet in a paper feed cassette or on the manual feed tray 12 to the print engine 22, feeds the sheet with the image transferred thereon by the print engine 22 to the fixing device 24, and ejects the sheet that has passed through the fixing device 24. The fixing device 24 fixes the transferred image on the sheet by heating and pressure application. A sheet size and type temperature setting table 25 holds preset temperatures for the fixing device 24 based on sheet sizes and types. Examples of the sheet types include plain paper, high-quality paper, recycled paper, thin paper, and thick paper.

A user interface ("UI") unit 30 displays a setting screen with a predetermined value on the display unit 111 in response to manipulation on the input unit 110 by the user. The UI unit 30 updates the predetermined value with a specified value in response to manipulation on the input unit 110 by the user, retains the updated value, and updates the displayed value. When the sheet size is specified by the user, the UI unit 30 calls up a fixing-device temperature setting unit 26 in the image forming unit 20.

Figure 3:
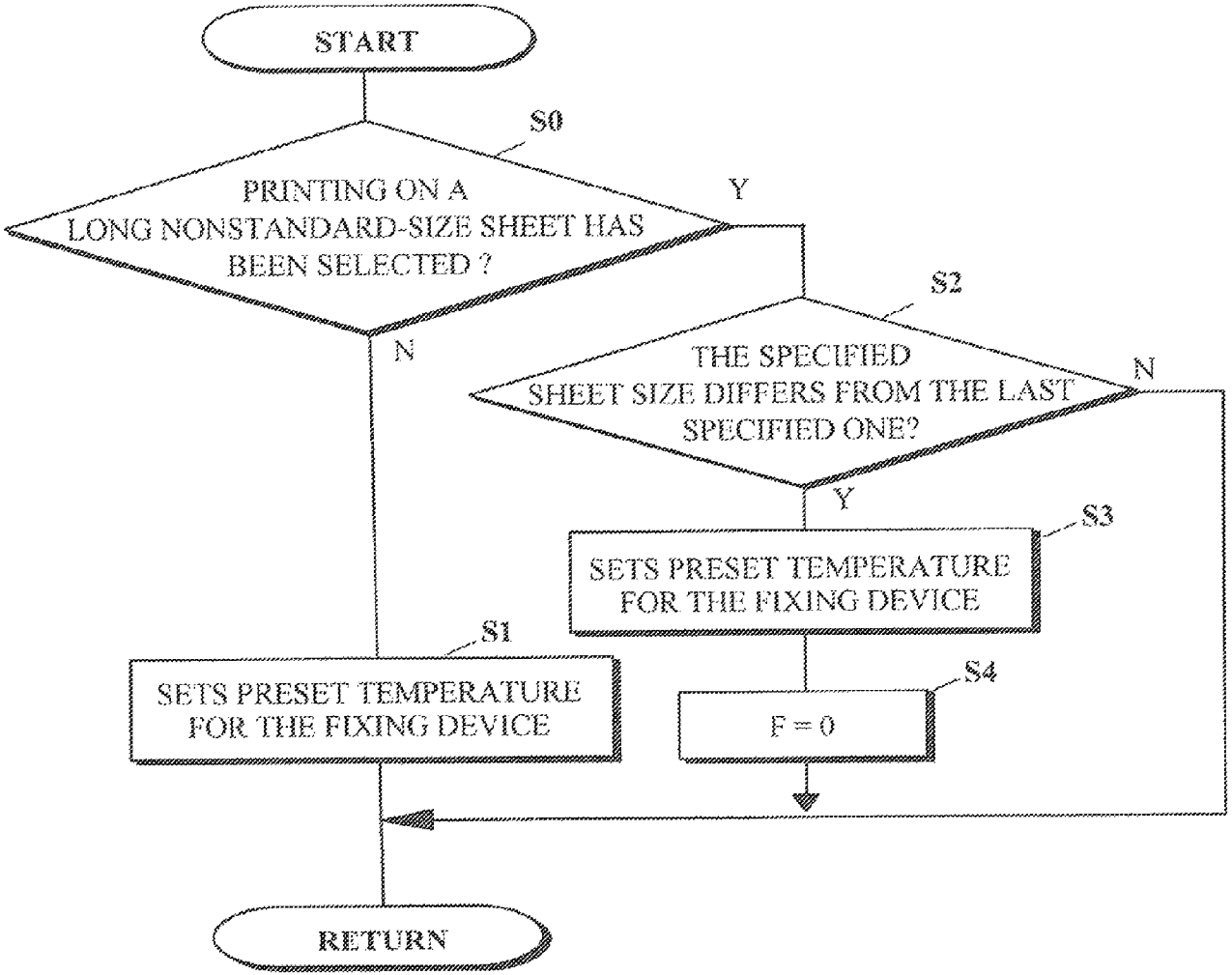
FIG. 3 shows a schematic flow chart that illustrates a process performed by a fixing-device temperature setting unit.

FIG. 3 shows a schematic flow chart that illustrates a process performed by the fixing-device temperature setting unit 26. In the following description, the letters between brackets indicate the identification reference number of a step.

(S0) The UI unit 30 determines whether printing on a long nonstandard-size sheet has been selected by the user. If the printing on the long nonstandard-size sheet has not been selected, the process proceeds to step S1. If the printing on the long nonstandard-size sheet has been selected, the process proceeds to step S2. At this time, the UI unit 30 retains information indicating that the printing on the long nonstandard-size sheet has been selected.

(S1) The UI unit 30 calls up the fixing-device temperature setting unit 26, refers to the sheet size and type temperature setting table 25, and reads a preset temperature corresponding to the specified sheet size and type. The fixing-device temperature setting unit 26 sets this temperature for the fixing device 24. The process illustrated in FIG. 3 is completed.

(S2) The UI unit 30 determines whether the specified value of the sheet size differs from the last specified value of the sheet size (including a specified value for a standard size). If the specified value of the sheet size differs from the last specified value, the process proceeds to step S3. If the specified value of the sheet size is the same as the last specified value, the process illustrated in FIG. 3 is completed.

(S3) The fixing-device temperature setting unit 26 calculates the preset temperature for the fixing device 24 using a predetermined computational expression based on the sheet type, width (sheet width in a direction perpendicular to the sheet feeding direction), and length (sheet length in the sheet feeding direction). The fixing-device temperature setting unit 26 sets the temperature of the fixing device 24 at the calculated temperature.

(S4) The fixing-device temperature setting unit 26 substitutes the initial value zero into a flag F. Then the process illustrated in FIG. 3 is completed.

Referring back to FIG. 2, a print control unit 31 controls the image forming unit 20 based on information indicating that the printing on the long nonstandard-size sheet has been selected retained in the UI unit 30, the value of the flag F, an instruction to start printing from the input unit 110 through the UI unit 30, and a notification of completion of ejecting paper from the image forming unit 20, as described below.

Figure 4:
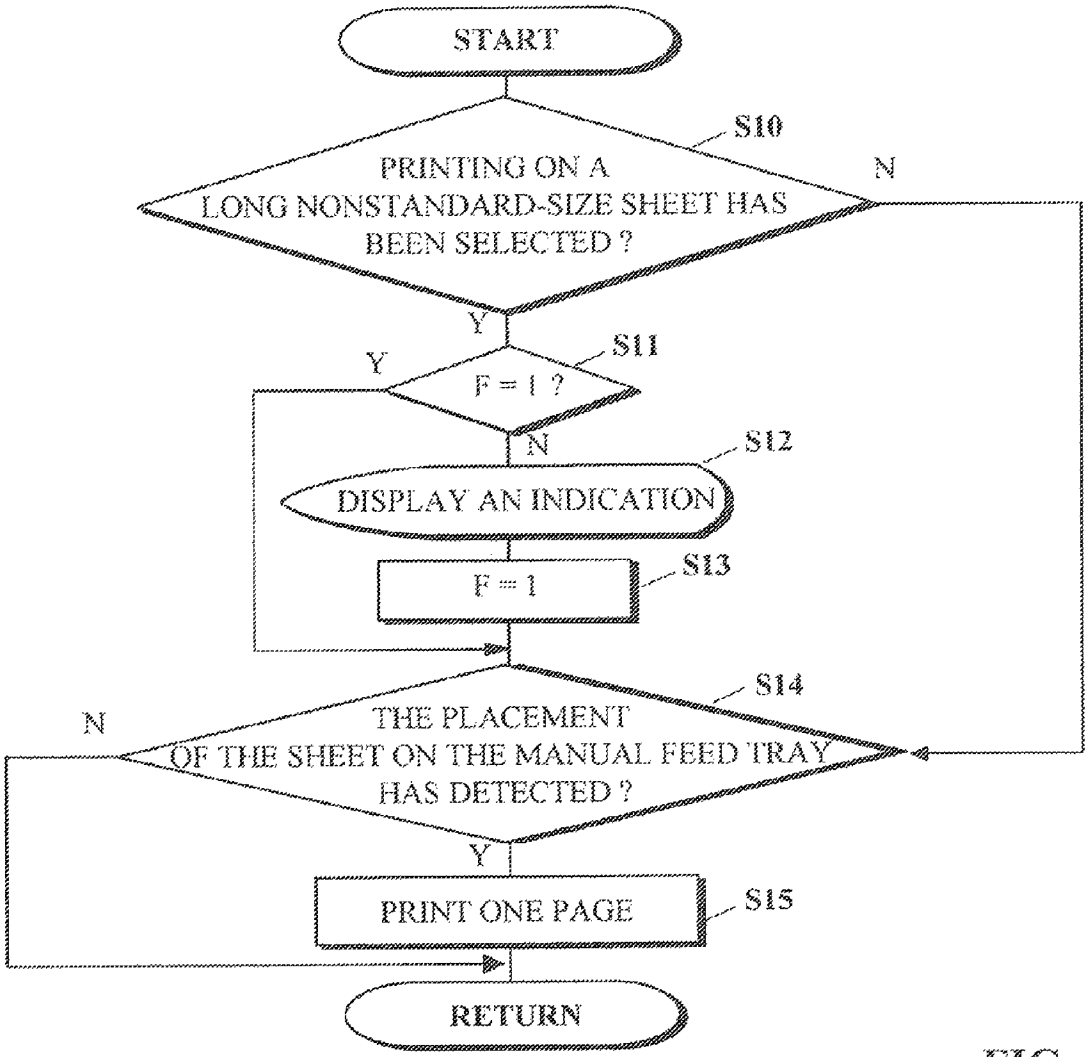
FIG. 4 shows a schematic flow chart that illustrates a process performed by a print control unit.

FIG. 4 shows a schematic flow chart that illustrates a process performed by the print control unit 31. This process begins in response to an instruction to start printing or a notification of completion of ejecting paper.

(S10) If information indicating that printing on a long nonstandard-size sheet has been selected is stored, the process proceeds to step S11. If not, the process proceeds to step S15.

(S11) If the value of the flag F is one, the process proceeds to step S14. If not, the process proceeds to step S12. For a new print job on a long nonstandard-size sheet, because the value of F becomes zero at step S4 in FIG. 3, the determination at step S11 is NO, and the process proceeds to step S12.

(S12) The print control unit 31 causes the display unit 111 to display an indication that prompts the user to identify the setting of the sheet size through the UI unit 30. When the user presses the start button on the input unit 110, the indication disappears, and the process proceeds to step S13.

(S13) The print control unit 31 substitutes one into the flag F.

(S14) If a manual feed tray sheet detecting unit 32 has detected the placement of the sheet on the manual feed tray 12, the process proceeds to step S15. If the manual feed tray sheet detecting unit 32 has not detected the sheet, the process illustrated in FIG. 4 is completed.

In the latter case, when the user places a new sheet on the manual feed tray 12 and presses the start button on the input unit 110, an instruction to start printing is provided to the print control unit 31, and the process illustrated in FIG. 4 starts again. When the process illustrated in FIG. 4 restarts, the process proceeds from step S10 to step S11. If the setting of the sheet size is not changed, because the process illustrated in FIG. 3 is not performed, the process proceeds from step S11 to step S14 to step S15.

(S15) The print control unit 31 provides the image forming unit 20 with an instruction to print one page of a next original.

In response to this instruction, the image forming unit 20 carries out the following control. The sheet conveying mechanism 23 feeds a single original on the original tray 13 illustrated in FIG. 1. The scanner 21 reads the image of the feed original. The print engine 22 performs developing and transferring based on the read image data. At this time, the sheet conveying mechanism 23 feeds the sheet on the manual feed tray 12 to the print engine 22, and feeds the sheet with the image transferred thereon by the print engine 22 to the fixing device 24. The fixing device 24 fixes the transferred image by heating and pressure application. Then the sheet conveying mechanism 23 ejects the sheet having passed through the fixing device 24.

According to an embodiment, unless the user changes the sheet size, step S4 in FIG. 3 is not performed, and the value of the flag F does not become zero. Accordingly, even if the user places sheets on the manual feed tray 12 one by one, the determination at step S11 in FIG. 4 is YES, and step S12 is skipped. This can avoid the inconvenience of displaying an indication that prompts the user to identify the sheet size at step S12 every time he or she places a sheet on the manual feed tray 12.

If the user changes the sheet size, step S4 in FIG. 3 is performed, and the value of the flag F becomes zero. With this, it is determined that a single print job on the sheet placed on the manual feed tray has been completed. If there is a next instruction to print on a nonstandard-size sheet with a size change, because it is determined that the sheet is the first page of a new job, an indication that prompts the user to identify the sheet size is displayed on the display unit 111 at a necessary timing.

An embodiment of the present disclosure is described above. The present disclosure includes various other modifications. The present disclosure includes embodiments using configurations that achieve the functions of the components described in the above embodiment and also includes other configurations of which those skilled in the art can conceive.

A copying case is described in the above embodiment. The present disclosure may also be a configuration in which a computer is connected to the image forming apparatus 10 with a communication medium and printing is performed through a printer driver in the computer, instead of using the scanner 21. In this configuration, the computer may convert a print target file into page-description language ("PDL") data, transmit it to the image forming apparatus 10, and perform substantially the same process as the above-described process using a screen and an input device in the computer, instead of the operation panel 11. In this case, the input unit and the display unit in the image forming apparatus are communication units.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An image forming apparatus comprising:

an input unit;

a display unit;

an image forming unit;

a user interface unit configured to cause information to be stored relating to printing a first page of a print job on a sheet placed on a manual feed tray; and a print control unit, wherein if printing on a long nonstandard-size sheet is selected through the input unit, the print control unit is configured to cause the display unit to display an indication that prompts a user to identify a sheet size of the sheet and to request the image forming unit to start printing the sheet on the manual feed tray in response to an instruction to start printing from the input unit, and if the information relating to execution of printing the first page is stored in the storage unit, the print control unit is configured to skip the step of displaying the indication that prompts the user to identify the sheet size on the display unit and to request the image forming unit to start the printing on the sheet placed on the manual feed tray, wherein the input unit is used in specifying the sheet size and a sheet type of the sheet therethrough, the image forming apparatus further comprising:

a fixing device; and a fixing-device temperature setting unit configured to set a temperature for the fixing device based on the sheet size and the sheet type specified through the input unit, wherein the fixing-device temperature setting unit is configured not to change the set temperature while the print job is performed, and wherein the user interface unit is configured to cause the image forming unit to determine that the print job for the sheet placed on the manual feed tray is completed, if the setting of the sheet size is changed through the input unit after the printing on the long nonstandard-size sheet is selected.

2. The image forming apparatus according to claim 1, wherein the fixing-device temperature setting unit is configured to set the temperature for the fixing device after the printing on the long nonstandard-size sheet is selected and before the printing begins.

3. A printing method of printing on a long nonstandard-size sheet, the printing method comprising:

selecting and inputting printing on a long nonstandard-size sheet;

storing information relating to printing a first page of a print job on a sheet placed on a manual feed tray;

displaying an indication that prompts a user to identify a sheet size of the sheet on a display unit and requesting an image forming unit to start printing the sheet on the manual feed tray in response to an instruction to start printing if printing on a long nonstandard-size sheet is selected;

skipping the step of displaying the indication that prompts the user to identify the sheet size on the display unit and requesting the image forming unit to start the printing on the sheet placed on the manual feed tray if the information relating to execution of printing the first page is stored;

specifying and inputting the sheet size and a sheet type of the sheet;

setting a temperature for a fixing device based on the sheet size and the sheet type specified through an input unit, wherein the set temperature is not changed while the print job is performed; and determining that the print job for the sheet placed on the manual feed tray is completed, if the setting of the sheet size is changed through the input unit after the printing on the long nonstandard-size sheet is selected.

4. The printing method according to claim 3, wherein setting the temperature for the fixing device based on the specified sheet size and the sheet type after the printing on the long nonstandard-size sheet is selected and before the printing is started.

* * * * *